US008676073B2

(12) United States Patent
Murata et al.

(10) Patent No.: US 8,676,073 B2
(45) Date of Patent: Mar. 18, 2014

(54) TONER TRANSPORTATION DEVICE, TONER CASE, IMAGE FORMING APPARATUS, AND METHOD OF CONTROLLING TONER TRANSPORTATION DEVICE

(75) Inventors: Koji Murata, Osaka (JP); Tatsuhiko Yoshii, Osaka (JP); Naoki Mizutani, Osaka (JP); Takeshi Fujimura, Osaka (JP); Naoki Yamane, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 138 days.

(21) Appl. No.: 13/427,403

(22) Filed: Mar. 22, 2012

(65) Prior Publication Data

US 2012/0243913 A1 Sep. 27, 2012

(30) Foreign Application Priority Data

Mar. 22, 2011 (JP) ..... 2011-062009

(51) Int. Cl.
*G03G 15/08* (2006.01)

(52) U.S. Cl.
USPC ..... 399/53; 399/27; 399/254; 399/263

(58) Field of Classification Search
USPC ..... 399/27, 53, 254, 255, 256, 258, 261, 399/262, 263
See application file for complete search history.

(56) References Cited

U.S. PATENT DOCUMENTS

| | | | | |
|---|---|---|---|---|
| 6,246,854 | B1 * | 6/2001 | Kurosawa et al. | 399/263 |
| 6,421,517 | B1 * | 7/2002 | Nishino et al. | 399/254 |
| 8,538,301 | B2 * | 9/2013 | Nakaue | 399/255 |
| 2002/0025173 | A1 | 2/2002 | Isobe et al. | |
| 2003/0021613 | A1 | 1/2003 | Koide | |
| 2003/0123889 | A1 | 7/2003 | Isobe et al. | |
| 2004/0131386 | A1 | 7/2004 | Koide | |
| 2005/0129417 | A1 * | 6/2005 | Asakura | 399/27 |
| 2009/0245877 | A1 * | 10/2009 | Choi et al. | 399/254 |
| 2010/0189455 | A1 | 7/2010 | Kim | |
| 2010/0239290 | A1 * | 9/2010 | Ryu | 399/53 |

FOREIGN PATENT DOCUMENTS

| | | |
|---|---|---|
| JP | 57-067964 | 4/1982 |
| JP | 60-222877 | 11/1985 |
| JP | 09-090754 | 4/1997 |
| JP | 2002006695 | 1/2002 |
| JP | 2003029483 | 1/2003 |
| JP | 2004-021230 | 1/2004 |
| JP | 2004-354689 | 12/2004 |
| JP | 2005-173362 | 6/2005 |
| JP | 2006010758 | 1/2006 |
| JP | 2008-083530 | 4/2008 |
| JP | 2009-223050 | 1/2009 |
| JP | 2009-036787 | 2/2009 |

OTHER PUBLICATIONS

European Search Report—EP 12160661—dated Oct. 15, 2012 (5 pages).

* cited by examiner

*Primary Examiner* — Sophia S Chen
(74) *Attorney, Agent, or Firm* — K&L Gates LLP

(57) ABSTRACT

A toner transportation device includes a toner case and a drive section. The toner case includes a main body containing toner, and an agitating unit rotatably mounted in the main body that agitates the toner. The drive section includes a driving unit driving the agitating unit, a detection unit detecting a driving unit driving state, and a control unit able to transmit a drive instruction signal to the driving unit and receive a detection signal regarding the driving unit driving state from the detection unit. The control unit determines whether the toner case is in an overload state in accordance with a detection signal reception state. The control unit performs a retry control, causing the driving unit to repeatedly rotate the agitating unit forward and backward when the control unit determines that the toner case is in an overload state.

7 Claims, 13 Drawing Sheets

TONER TRANSPORTATION DEVICE, TONER CASE, IMAGE FORMING APPARATUS, AND METHOD OF CONTROLLING TONER TRANSPORTATION DEVICE

INCORPORATION BY REFERENCE

This application is based upon and claims the benefit of priority from the corresponding Japanese Patent application No. 2011-062009, filed Mar. 22, 2011, the entire contents of which is incorporated herein by reference.

BACKGROUND

The present disclosure relates to a toner transportation device that supplies toner to a developing unit, a toner case that contains toner, an image forming apparatus equipped with the toner transportation device and the toner case, and method of controlling the toner transportation device.

Today, in electrophotographic image forming apparatuses, toner is supplied from a developing unit to an electrostatic latent image formed on the surface of a photoconductor drum, or the like, to perform a developing process. Toner used in such a developing process is supplied to the developing unit from a toner case using a transportation unit while being agitated by an agitating unit.

In an image forming apparatus having such a structure, the toner case may be in an overload state immediately after the toner case is replaced or when an image forming operation has not been performed for a long time. Herein, an overload state of the toner case refers to a state wherein toner has become clumped in the toner case because of the weight of the toner or due to other causes. When the toner is supplied from the toner case to the developing unit in such a state, an excessive load torque is applied to a driving unit that drives the transportation unit and the agitating unit. As a result, there is a possibility of the driving unit being damaged.

In order to prevent such a situation from occurring, there are known image forming apparatuses that stop the driving unit, when it is detected that the toner case is in an overload state, and displays a warning notice that prompts a user, for example, to remove the toner container, shake the toner container well, and remount the toner container, or displays an error notice that prompts the user to contact a service engineer.

However, when the above-described warning notice is displayed, an operation to clear the overload state of the toner container will be performed by the user. This increases the amount of work performed by the user. When the error notice is displayed, the user cannot use the image forming apparatus until the toner container is replaced by a service engineer. This decreases convenience.

SUMMARY

According to an embodiment of the present disclosure, a toner transportation device is provided that includes a toner case and a drive section. The toner case includes a main body that contains toner, and an agitating unit rotatably positioned in the main body that agitates the toner. The drive section includes a driving unit that drives the agitating unit, a detection unit that detects a driving state of the driving unit, and a control unit that is able to transmit a drive instruction signal to the driving unit and is able to receive a detection signal regarding the driving state of the driving unit from the detection unit. In the toner transportation device, the control unit determines whether or not the toner case is in an overload state in accordance with a reception state of the detection signal from the detection unit. The control unit performs a retry control when the control unit determines that the toner case is in the overload state. The retry control causes the driving unit to repeatedly rotate the agitating unit forward and backward.

According to another embodiment of the present disclosure, a toner case is provided that includes a main body that contains toner, and an agitating unit rotatably positioned in the main body that agitates the toner. The toner case is connected to a toner transportation device that includes a drive section. The drive section includes a driving unit that drives the agitating unit, a detection unit that detects a driving state of the driving unit, and control unit that is able to transmit a drive instruction signal to the driving unit and is able to receive a detection signal regarding the driving state of the driving unit from the detection unit. The control unit determines whether or not the toner case is in an overload state in accordance with a reception state of the detection signal from the detection unit. The control unit performs a retry control when the control unit determines that the toner case is in the overload state. The retry control causes the driving unit to repeatedly rotate the agitating unit forward and backward.

According to yet another embodiment of the present disclosure, an image forming apparatus is provided that includes a toner case, a drive section, and a control unit. The toner case includes a main body that contains toner, and an agitating unit rotatably positioned in the main body and agitates the toner. The drive section includes a driving unit that drives the agitating unit, and a detection unit that detects a driving state of the driving unit. The control unit is able to transmit a drive instruction signal to the driving unit and is able to receive a detection signal regarding the driving state of the driving unit from the detection unit. The control unit determines whether or not the toner case is in an overload state in accordance with a reception state of the detection signal from the detection unit. The control unit performs a retry control when the control unit determines that the toner case is in the overload state. The retry control causes the driving unit to repeatedly rotate the agitating unit forward and backward.

According to yet another embodiment of the present disclosure, a method of controlling a toner transportation device that includes a toner case including an agitating unit that agitates toner, and a drive section including a driving unit that drives the agitating unit. The method includes transmitting a drive instruction signal to the driving unit, detecting a driving state of the driving unit and determining whether or not the toner case is in an overload state, and performing a retry control when it is determined that the toner case is in the overload state. The retry control causes the driving unit to repeatedly rotate the agitating unit forward and backward.

Additional features and advantages are described herein, and will be apparent from the following Detailed Description and the figures.

DETAILED DESCRIPTION

Figure 1:
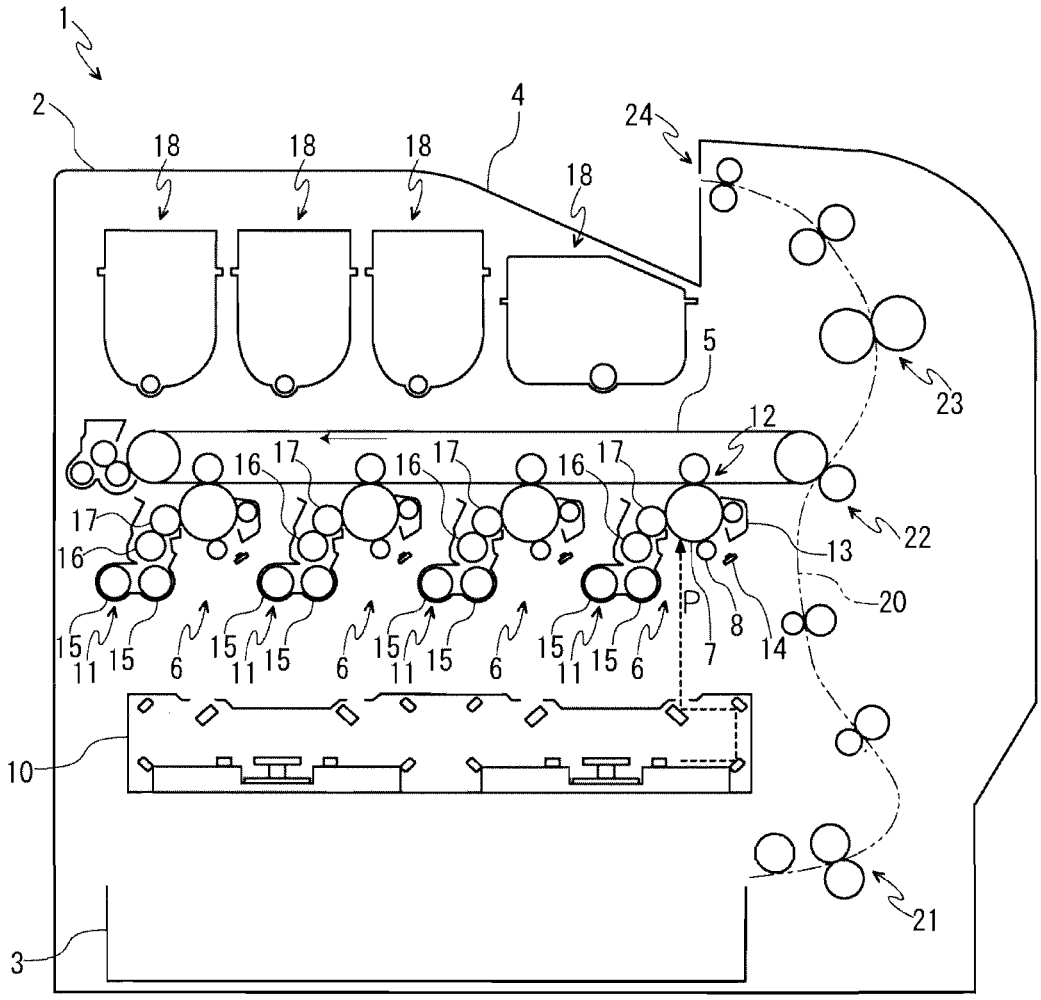
FIG. 1 is a schematic diagram illustrating an outline of a structure of a color printer according to an embodiment of the present disclosure.

The general structure of a color printer 1 is initially described with reference to FIG. 1. The color printer 1 serves as an image forming apparatus. FIG. 1 is a schematic diagram illustrating an outline of the structure of the color printer according to an embodiment of the present disclosure.

The color printer 1 includes a box-shaped printer main body 2. A sheet feed cassette 3 is provided in a lower portion of the printer main body 2. Sheets of transfer paper (not shown) are loaded in the sheet feed cassette 3. A delivery tray 4 is provided at an upper end of the printer main body 2.

An intermediate transfer belt 5 is provided in an upper portion of the printer main body 2. The intermediate transfer belt 5, which serves as an image carrying body, is stretched around a plurality of rollers. An exposure unit 10, which includes a laser scanning unit (LSU), is located below the intermediate transfer belt 5. A plurality of image forming units 6 are provided along a lower portion of the intermediate transfer belt 5. The image forming units 6 are provided for corresponding colors that include, for example, yellow (Y), magenta (M), cyan (C), and black (K). A photoconductor drum 7 is rotatably mounted in each of the image forming units 6. A charger 8, a developing unit 11, a primary transfer unit 12, a cleaning device 13, and an eraser 14 are disposed around the photoconductor drum 7 in the order of processes of primary transfer.

A pair of agitating rollers 15 is located in a lower portion of each of the developing unit 11. A magnetic roller 16 is positioned above each pair of the agitating rollers 15, and a developing roller 17 is located above each magnetic roller 16. Toner transportation devices 18 are positioned above the developing units 11. The details of the toner transportation devices 18 will be described later.

A transportation path 20, through which a transfer sheet is transported, is formed on one side (right side in FIG. 1) of the printer main body 2. Along the transportation path 20, a sheet feed unit 21 is located at an upstream end, a secondary transfer unit 22 is located at one end (right end in FIG. 1) of the intermediate transfer belt 5 in a midstream, a fixing unit 23 is provided in a downstream, and a sheet delivery port 24 is located at a downstream end.

Next, an image forming operation of the color printer 1 having the above-described structure will be described.

When power to the color printer 1 is turned on, a variety of parameters are initialized, and initial settings such as a temperature setting of the fixing unit 23 are performed. When image data is inputted to the color printer 1 from a computer or the like connected to the color printer 1 and the color printer 1 is instructed to start printing, the image forming operation is performed as follows.

A surface of one of the photoconductor drums 7 is initially charged by the corresponding charger 8. After that, the photoconductor drum 7 is exposed to laser light (see arrow P in FIG. 1) emitted from the exposure unit 10 corresponding to the image data, thereby forming an electrostatic latent image on the surface of the photoconductor drum 7. Next, the developing unit 11 develops the electrostatic latent image to a toner image of a corresponding one of the colors. This toner image undergoes primary transfer onto a surface of the intermediate transfer belt 5 using the primary transfer unit 12. The image forming units 6 sequentially performs the above-described operation to form a full-color toner image on the intermediate transfer belt 5. Toner and electrical charges remaining on the photoconductor drums 7 are removed by the cleaning device 13 and the eraser 14.

A transfer sheet picked up by the sheet feed unit 21 from the sheet feed cassette 3 or a manual feed tray (not shown) is transported to the secondary transfer unit 22 at a rate adjusted to the timing of the image forming operation. The full-color toner image on the intermediate transfer belt 5 undergoes secondary transfer onto the transfer sheet in the secondary transfer unit 22. The transfer sheet onto which the secondary transfer of the toner image has been performed is transported toward the downstream through the transportation path 20 and enters the fixing unit 23. The fixing unit 23 fixes the toner image onto the transfer sheet. The transfer sheet onto which the toner image has been fixed is delivered to the delivery tray 4 from the sheet delivery port 24.

Figure 2:
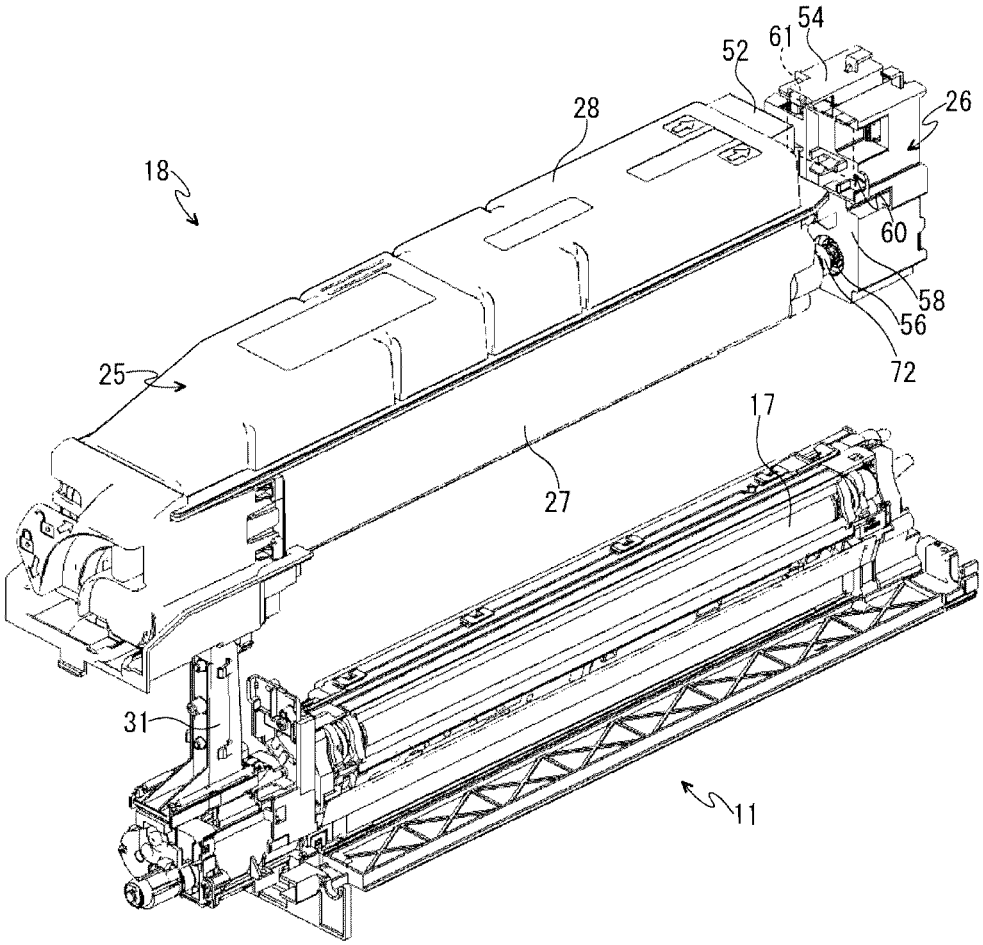
FIG. 2 is a perspective view illustrating connection of a toner transportation device to a developing unit in the color printer according to an embodiment of the present disclosure.
Figure 3:
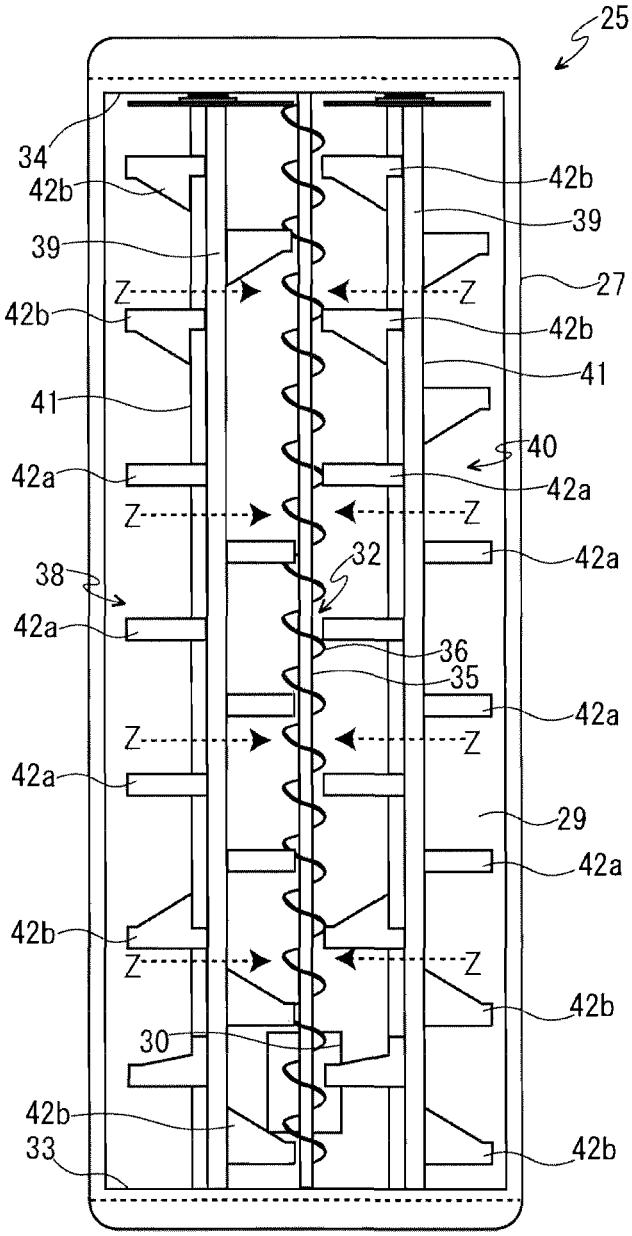
FIG. 3 is a plan view of a toner container with a cover of the toner container removed in the color printer according to an embodiment of the present disclosure.
Figure 4:
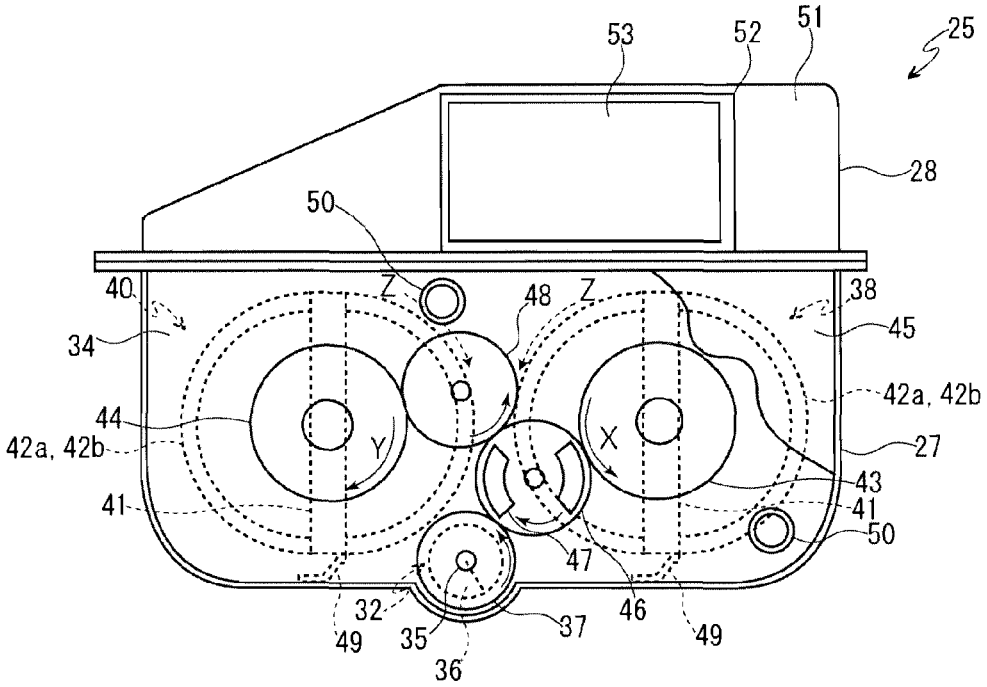
FIG. 4 is a rear view of a gear mechanism provided in the toner container in the color printer according to an embodiment of the present disclosure.
Figure 5:
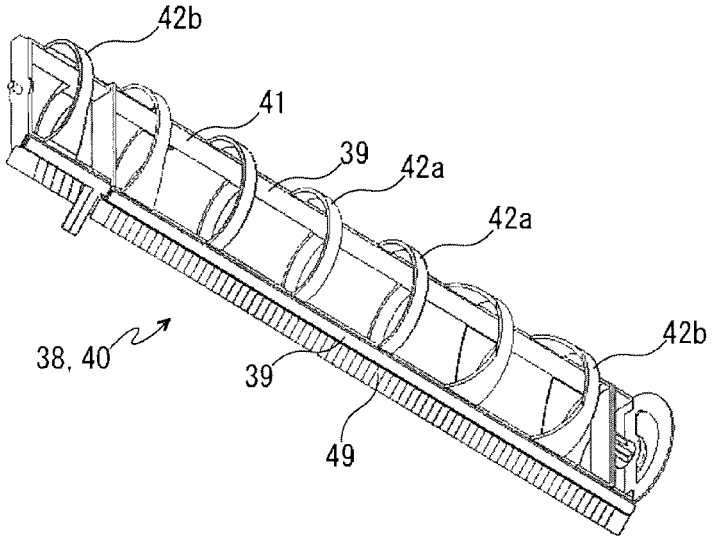
FIG. 5 is a perspective view illustrating an agitating paddle used as first and second agitating paddles in the color printer according to an embodiment of the present disclosure.
Figure 6:
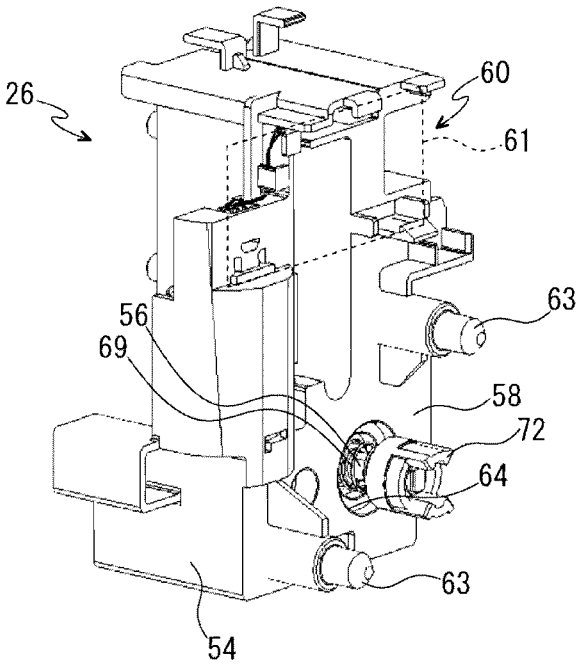
FIG. 6 is a front perspective view of a container drive section in the color printer according to an embodiment of the present disclosure.
Figure 7:
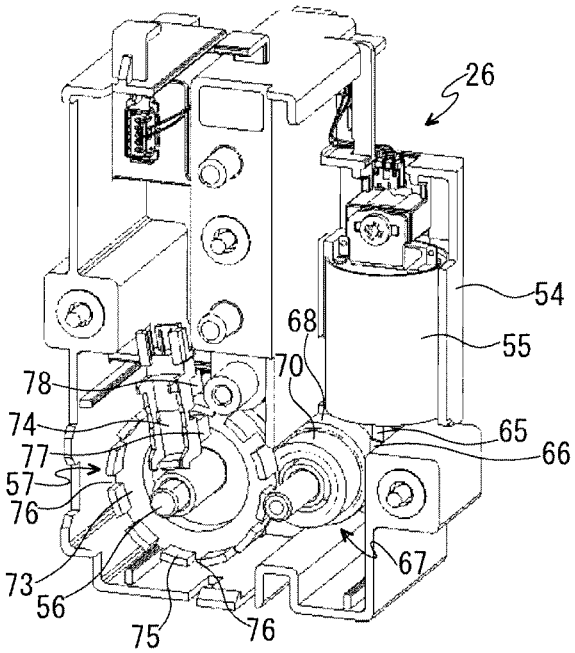
FIG. 7 is a rear perspective view of the container drive section in the color printer according to an embodiment of the present disclosure.
Figure 8:
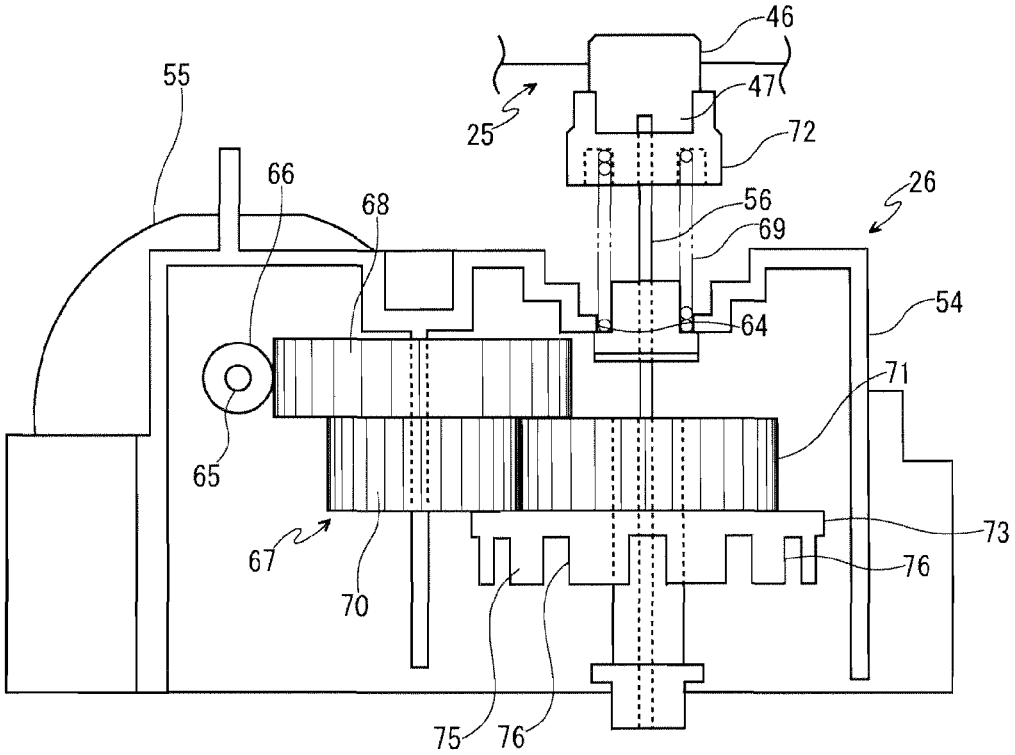
FIG. 8 is a bottom view of the gear mechanism provided in the container drive section in the color printer according to an embodiment of the present disclosure.

Next, the structure of the toner transportation device 18 will be described with reference to FIGS. 2 to 8. For convenience of explanation, a left front side in FIG. 2 is hereafter referred to as a front surface side of the toner transportation device 18. FIG. 2 is a perspective view illustrating connection of the toner transportation device to the developing unit in the color printer according to an embodiment of the present disclosure. FIG. 3 is a plan view of a toner container with a cover of the toner container removed in the color printer according to an embodiment of the present disclosure. FIG. 4 is a rear view of a gear mechanism provided in the toner container in the color printer according to an embodiment of the present disclosure. FIG. 5 is a perspective view illustrating an agitating paddle used as first and second agitating paddles in the color printer according to an embodiment of the present disclosure. FIG. 6 is a front perspective view of a container drive section in the color printer according to an embodiment of the present disclosure. FIG. 7 is a rear perspective view of the container drive section in the color printer according to an embodiment of the present disclosure. FIG. 8 is a bottom view of the gear mechanism provided in the container drive section in the color printer according to an embodiment of the present disclosure.

As illustrated in FIG. 2, each toner transportation device 18 includes a toner container 25 and a container drive section 26.

The toner container 25, which serves as a toner case, is provided above the corresponding one of the developing units 11. The container drive section 26 is connected to one longitudinal end (rear end in an embodiment) of the toner container 25.

The toner container 25 contains toner. The toner container 25 is removably mounted in a toner container mounting unit (not shown) provided in the printer main body 2. The toner container 25 is replaceable when the toner container 25 has run out of toner.

The toner container 25 includes a main body 27 and a cover 28. The main body 27, which serves as a main body of the case, has a box shape with an upper side open, and the cover 28 covers the upper side of the main body 27.

As illustrated in FIG. 3, the main body 27 has a bottom wall 29. A discharge port 30 is formed in a front portion of the bottom wall 29. The discharge port 30 is connected to an inner portion of the developing unit 11 through a pipe 31 (see FIG. 2) positioned therebetween in a position substantially vertical to the printer main body 2. When the toner container 25 is not mounted in the printer main body 2, the discharge port 30 is closed by a rotating shutter (not shown), which is connected to a lever (not shown). Mounting the toner container 25 in the printer main body 2 unlocks the lever. Then, operation of the lever by a user causes the shutter to rotate, thereby opening the discharge port 30. Although the rotating shutter is used as described above in an embodiment, a sliding shutter may be used in another embodiment. In this case, mounting the toner container 25 in the printer main body 2 causes the discharge port 30 to be opened.

In the main body 27, a transportation screw 32, which functions as a transportation unit, is rotatably mounted above the discharge port 30. The transportation screw 32 includes a rotation shaft 35, a spiral fin 36, and a transportation gear 37 (see FIG. 4). Longitudinal end portions of the rotation shaft 35 are rotatably supported by front and rear side walls 33 and 34 of the main body 27. The spiral fin 36 is located in an outer periphery of the rotation shaft 35 so as to be concentric with the rotation shaft 35. The transportation gear 37 is located at one of the longitudinal ends (rear end in an embodiment) of the rotation shaft 35.

A first agitating paddle 38 and a second agitating paddle 40 are located in the main body 27. The first agitating paddle 38, which functions as a first agitating unit, is rotatably provided on one side above the transportation screw 32 (upper left side in an embodiment). The second agitating paddle 40, which functions as a second agitating unit, is rotatably mounted on another side above the transportation screw 32 (upper right side in an embodiment). In an embodiment, the counterclockwise direction, as viewed from the rear side, is referred to as the forward rotation direction of the first agitating paddle 38 (see arrow X in FIG. 4), and the clockwise direction is referred to as the forward rotation direction of the second agitating paddle 40 (see arrow Y in FIG. 4).

Each of the agitating paddles 38 and 40 is rotatably supported in a direction parallel to the rotation shaft 35 of the transportation screw 32 and has a shape extending in the axial direction. As most illustrated in FIG. 5, each of the agitating paddles 38 and 40 has a rectangular frame plate-shaped supporting frame 41 provided in the axial direction. Front and rear end portions of each of the supporting frames 41 are rotatably supported by the front and rear side walls 33 and 34 of the main body 27. The supporting frame 41 has a pair of securing plates 39 (securing members) provided in the axial direction. The pair of securing plates 39 oppose each other.

On each of the pair of securing plates 39, a plurality of agitating members 42*a* and 42*b* are positioned in the axial direction of the supporting frame 41. The plurality of agitating members 42*a* and 42*b* are spaced apart a specified distances. Each of the agitating members 42*a* and 42*b* is formed so as to have a semi-circular arc shape and positioned perpendicular to the axial direction of the supporting frame 41. Each end of each of the agitating members 42*a* and 42*b* is secured to a corresponding one of the supporting frames 41. In each of the agitating paddles 38 and 40, the agitating members 42*a* and 42*b* are secured to the supporting frame 41 in a staggered manner such that the longitudinal position of any one of agitating members 42*a* and 42*b* does not overlap the other agitating members 42*a* and 42*b* (see FIG. 3). The agitating members 42*a* are located in a central portion in the axial direction of each supporting frame 41. The width of each agitating member 42*a* is substantially uniform. The agitating members 42*b* are located on one side and the other side of each supporting frame 41 in the axial direction of the supporting frame 41. Each agitating member 42*b* has reverse-taper shapes so that, on a central side of the agitating member 42*b* in the axial direction of the supporting frame 41, a dimension of the agitating member 42*b* in the axial direction of the supporting frame 41 increases from a central portion toward each end portion of the agitating member 42*b*.

An agitating film 49 is secured to an outer surface of one of the securing plates 39 from the front to rear end portions. The agitating films 49 rotate together with the corresponding agitating paddles 38 and 40 so as to contact and move away from an inner wall surface of the main body 27. That is, each of the agitating films 49 slidingly contacts the inner wall surface of the main body 27 when the agitating film 49 is positioned on a lower side of the supporting frame 41 due to rotation of the corresponding agitating paddle 38 or 40. Each of the agitating films 49 moves away from the inner wall surface of the main body 27 when the agitating film 49 is positioned on an upper side of the supporting frame 41 due to the rotation of the corresponding agitating paddle 38 or 40.

The rotational phases of the agitating paddles 38 and 40 are adjusted such that, at the start of use of the toner container 25 (immediately after replacement of the toner container 25), the agitating film 49 of each of the agitating paddles 38 and 40 contacts the inner wall surface of the main body 27 (see FIG. 4). That is, the rotational positions in which the agitating paddles 38 and 40 are mounted are adjusted such that the agitating films 49 are positioned on the lower side of the corresponding supporting frames 41 at the start of use of the toner container 25. With the above-described structure, toner is easily broken up due to vibrations transmitted from the agitating films 49 to the main body 27 when a retry control is performed. The retry control will be described hereinafter. The rotational phases may be adjusted such that the agitating films 49 are brought into contact with the inner wall surface of the main body 27 every time the agitating paddles 38 and 40 are stopped. A first agitating gear 43 is located in the rear end portion of the supporting frame 41 of the first agitating paddle 38. A second agitating gear 44 is located in the rear end portion of the supporting frame 41 of the second agitating paddle 40.

As illustrated in FIG. 4, a rear surface cover 45 is mounted on the rear side wall 34 of the main body 27. In FIG. 4, only part of the rear surface cover 45 is illustrated. Near a lower central portion of the rear side wall 34, a first idle gear 46 is provided. The first idle gear 46 is engaged with the transportation gear 37 and the first agitating gear 43. In an embodiment, the gear ratio of the first idle gear 46 to the transportation gear 37 is set to 3:2. The first idle gear 46 has a container-side joint 47. A second idle gear 48 is engaged with the first idle gear 46 and the second agitating gear 44. The second idle gear 48 is formed to have a size and shape similar to those of the first idle gear 46. The rear side wall 34 of the main body 27 has a pair of cylindrically shaped engaging cylinders 50 provided in the upper central portion and the lower left end portion.

The cover 28 is secured to the main body 27 using ultrasonic welding. The cover 28 has a rectangular-shaped protrusion 52 arranged on a rear wall 51 thereof. An integrated circuit (IC) tag 53 (a radio frequency identification (RFID) tag) is attached to the protrusion 52. The details of the IC tag 53 will be described hereinafter.

The container drive section 26 is located in a rear portion of the printer main body 2. The container drive section 26 is removably mounted to the toner container 25. As illustrated in FIGS. 6 and 7, the container drive section 26 includes a frame member 54, a drive motor 55, an output shaft 56, and a detection unit 57. The frame member 54 is an outer frame of the container drive section 26. The drive motor 55, which functions as a driving unit, is secured to the frame member 54 on one side (left side in the present embodiment) of the frame member 54 in a substantially vertical position. The output shaft 56 positioned in the longitudinal direction is rotatably supported on the other side (right side in the present embodiment) of the frame member 54. The detection unit 57 is located at a rear end of the output shaft 56.

A substrate mounting unit 60 is located at a position on a front surface 58 of the frame member 54 corresponding to the position of the protrusion 52 of the toner container 25. A substrate 61 (an RFID substrate) is mounted on this substrate mounting unit 60. When the toner container 25 is mounted in the printer main body 2, the substrate 61 opposes the IC tag 53. The details of the substrate 61 will be described hereinafter. Engaging protrusions 63 are located at positions on the front surface 58 of the frame member 54 corresponding to the positions of the corresponding engaging cylinders 50 of the toner container 25. When the toner container 25 is mounted in the printer main body 2, the engaging cylinders 50 are engaged with the corresponding engaging protrusions 63. An insertion hole 64 is formed in a horizontal direction in a lower central portion of the frame member 54.

The drive motor 55 is a direct-current (DC) brush motor. In another embodiment, as the drive motor 55, any motor may be used such as a DC brushless motor or a stepping motor instead of a DC brush motor. The drive motor 55 has a motor shaft 65 extending downward, to which a worm 66 is secured. As illustrated in FIG. 8, the worm 66 is engaged with a large diameter portion 68 of a worm gear 67 rotatably supported by the frame member 54. A small diameter portion 70 of the worm gear 67 is engaged with an output gear 71, which rotates together with the output shaft 56. When the drive motor 55 rotates, the rotation of the drive motor 55 is transmitted to the output shaft 56 through the worm 66, the worm gear 67, and the output gear 71, thereby rotating the output shaft 56.

The output shaft 56 is urged forward by a coil spring 69. A front portion of the output shaft 56 is inserted through the insertion hole 64. A drive section-side joint 72 is provided at a front end of the output shaft 56. The drive section-side joint 72 is located at a position corresponding to the position of the container-side joint 47, which is provided in the first idle gear 46 of the toner container 25. Mounting of the toner container 25 in the printer main body 2 causes the container-side joint 47 to be engaged with the drive section-side joint 72, thereby allowing rotation of the output shaft 56 to be transmitted to the first idle gear 46 of the toner container 25.

As illustrated in FIG. 7, the rotation detection unit 57 includes a pulse plate 73 and a sensor 74. The pulse plate 73 is positioned on the rear end of the output shaft 56 so as to be rotatable together with the output shaft 56. The sensor 74 is secured to the frame member 54 at a position above the pulse plate 73. The pulse plate 73 is integrated with the output gear 71 (see FIG. 8). A light shielding portion 75 is provided in an outer periphery of the pulse plate 73. The light shielding portion 75 has a rearwardly protruding flange-like shape. The light shielding portion 75 has 12 slits 76 equally spaced in a peripheral direction thereof.

The sensor 74 is a photo interrupter sensor (a PI sensor) and includes a light emitter 77 and a light receiver 78. The light emitter 77 is located inside the light shielding portion 75 in a radial direction of the pulse plate 73. The light receiver 78 is located outside the light shielding portion 75 in the radial direction of the pulse plate 73. The light emitter 77 and the light receiver 78 are located opposite each other and are positioned on one side and the other side of the light shielding portion 75. When the pulse plate 73 rotates, a detection light path from the light emitter 77 to the light receiver 78 is formed and interrupted by the slits 76 and the light shielding portion 75. By detecting formation and interruption, rotation of the pulse plate 73 can be detected. The pulse plate 73 rotates as the drive motor 55 and the transportation screw 32 rotate in an interlocked manner. Accordingly, rotation of the drive motor 55 and the transportation screw 32 can be detected by detecting rotation of the pulse plate 73.

In an embodiment, since the pulse plate 73 has 12 slits 76, the sensor 74 detects 12 pulses during one rotation of the pulse plate 73. As described above, the gear ratio of the first idle gear 46, which is connected to the output shaft 56, to the transportation gear 37, which is provided to the transportation screw 32, is set to 3:2. Accordingly, while the transportation screw 32 performs one rotation, the output shaft 56 performs two thirds of a rotation, as a result of which the sensor 74 detects eight pulses.

Figure 9:
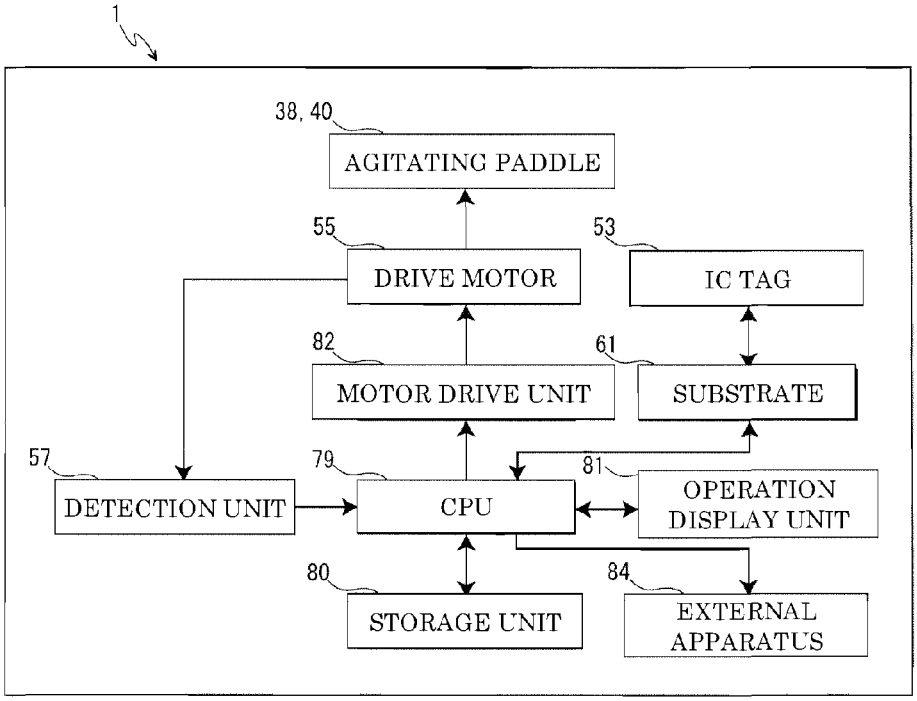
FIG. 9 is a block diagram illustrating the configuration of the color printer according to an embodiment of the present disclosure.

Next, the control system of the color printer 1 will be described with reference to FIG. 9. FIG. 9 is a block diagram illustrating the configuration of the color printer according to an embodiment of the present disclosure.

The color printer 1 includes a central processing unit (CPU) 79, which serves as a control unit. The CPU 79 is connected to a storage unit 80, which includes storage devices such as a read-only memory (ROM) and a random access memory (RAM). The CPU 79 controls each part of the color printer 1 in accordance with a control program and control data stored in the storage unit 80. The control unit may be arranged in the container drive section 26.

The CPU 79 is also connected to an operation display unit 81 positioned in the printer main body 2. The operation display unit 81 includes operation keys such as, for example, a start key, a stop/clear key, a power key, a tenkey, and a touch screen. When the user operates one of the operation keys, a corresponding one of operational instructions is output to the CPU 79. The operation display unit 81 displays various information including, for example, error messages and the remaining amount of toner in accordance with signals output from the CPU 79.

The CPU 79 is connected to the above-described rotation detection unit 57. A rotation detection signal of the drive motor 55 and the transportation screw 32 (simply referred to as "rotation detection signal" hereafter) detected by the rotation detection unit 57 is output from the rotation detection unit 57 to the CPU 79.

The CPU 79 is connected to a motor drive unit 82. Current flows from the motor drive unit 82 to the drive motor 55 in accordance with a drive instruction signal from the CPU 79, thereby rotating the motor shaft 65 of the drive motor 55. The motor drive unit 82 may use, for example, an existing known motor drive circuit that includes a transistor and a resistor.

The CPU 79 communicates with an external apparatus 84 (for example, a host computer for failure control) provided outside the color printer 1 via, for example, a personal handyphone system (PHS) communication or the like, so that the CPU 79 can notify the external apparatus 84 of an operational state of the color printer 1 and the like where necessary.

The CPU 79 is connected to the substrate 61 (RFID substrate) provided in the container drive section 26 as described above. The substrate 61 and the IC tag 53 (RFID tag), which opposes the substrate 61 and is bonded to the toner container 25 as described above, perform wireless communication with each other as follows.

The IC tag 53 includes a non-volatile memory. This memory stores information about the toner container 25 including, for example, the number of rotations of the transportation screw 32, a type number, a date of manufacture, a serial number, usage history, a color of toner. The substrate 61 functions to read the information stored in the memory of the IC tag 53 and outputs the read information to the CPU 79 in accordance with a signal from the CPU 79. The CPU 79 performs a variety of determinations in accordance with the information about the toner container 25 having been read by the substrate 61. The CPU 79 causes the operation display unit 81 to display a determination result where necessary. For example, the CPU 79 determines whether or not the toner container 25 is a genuine part. The substrate 61 also functions to write various information to the IC tag 53. For example, the substrate 61 writes to the IC tag 53 the number of times the rotation detection signal has been output from the rotation detection unit 57 to the CPU 79. Thus, the substrate 61 has a function of a reader/writer that reads from and writes to the IC tag 53.

When a particular toner container 25 is removed from the main body 2, the information about the toner container 25 is erased from the CPU 79. However, the non-volatile memory of the IC tag 53 still retains information about the toner container 25. When the particular toner container 25 is again mounted in the printer main body 2, the information about the toner container 25 retained in the memory of the IC tag 53 is read by the substrate 61 and output to the CPU 79, thereby restoring the information about the toner container 25 to the CPU 79.

Next, an operation in which toner is supplied from one of the toner transportation devices 18 to a corresponding one of the developing units 11 in the above-described color printer 1 will be described.

When the image forming operation, as described above, is performed, and accordingly, toner in the developing unit 11 is consumed, the CPU 79 determines whether or not the toner needs to be supplied to the developing unit 11 from the toner container 25. This determination may be performed, for example, based on the toner consumption calculated by the CPU 79 based on the rotation detection signal received from the rotation detection unit 57. Alternatively, the determination may be performed based on the toner consumption calculated by the CPU 79 based on a signal regarding the toner concentration or the amount of toner received from a toner sensor (not shown) provided in the developing unit 11. Alternatively, the determination may be performed based on the toner consumption calculated by the CPU 79 based on the number of dots of developed images.

When the CPU 79 determines that toner needs to be supplied to the developing unit 11 as a result of the above-described determination, the CPU 79 outputs a drive instruction signal to the motor drive unit 82 to cause a current to flow from the motor drive unit 82 to the drive motor 55, thereby rotating the motor shaft 65 of the drive motor 55. The rotation of the motor shaft 65 is transmitted to the output shaft 56 through the worm 66, the worm gear 67, and the output gear 71, thereby rotating the output shaft 56. The rotation of the output shaft 56 is transmitted to the first idle gear 46 through the drive section-side joint 72 and the container-side joint 47.

By this means, as illustrated in FIG. 4, the first idle gear 46 rotates in a first direction (clockwise in FIG. 4) as the drive motor 55 rotates. As the first idle gear 46 rotates, the transportation gear 37, which is engaged with the first idle gear 46, rotates in a second direction (counterclockwise in FIG. 4), thereby rotating the transportation screw 32 also in the second direction. As a result, the toner contained in the toner container 25 is transported from the discharge port 30 to the developing unit 11 through the pipe 31. Thus, the toner is supplied to the developing unit 11.

As the above-described first idle gear 46 rotates, the first agitating gear 43, which is engaged with the first idle gear 46, rotates in the second direction, thereby rotating the first agitating paddle 38 in the forward rotation direction (see arrow X in FIG. 4). At the same time, the second idle gear 48, which is engaged with the first idle gear 46, rotates in the second direction. This causes the second agitating gear 44, which is engaged with the second idle gear 48, to rotate in the first direction, thereby rotating the second agitating paddle 40 in the forward rotation direction (see arrow Y in FIG. 4). As the agitating paddles 38 and 40 rotate in their respective forward rotation directions, the toner contained in the toner container 25 is agitated while being transported in directions toward the transportation screw 32 (in directions indicated by dotted arrows Z). As the agitating paddles 38 and 40 rotate, the agitating films 49 provided on the agitating paddles 38 and 40 slidingly contact the inner wall surface of the main body 27 and agitate the toner while scraping off the toner adhering to the inner wall surface of the main body 27.

The rotational phases of the agitating paddles 38 and 40 are adjusted such that the agitating films 49 are brought into contact with the inner wall surface of the main body 27 when the agitating paddles 38 and 40 are stopped (see FIG. 4). By way of example, the rotational phases are adjusted as follows. The CPU 79 calculates the phases of the agitating paddles 38 and 40 based on the number of times the rotation detection signal has been output from the detection unit 57, and outputs a drive stop signal to the motor drive unit 82 at positions where the agitating films 49 contact the inner wall surface of the main body 27.

Figure 10:
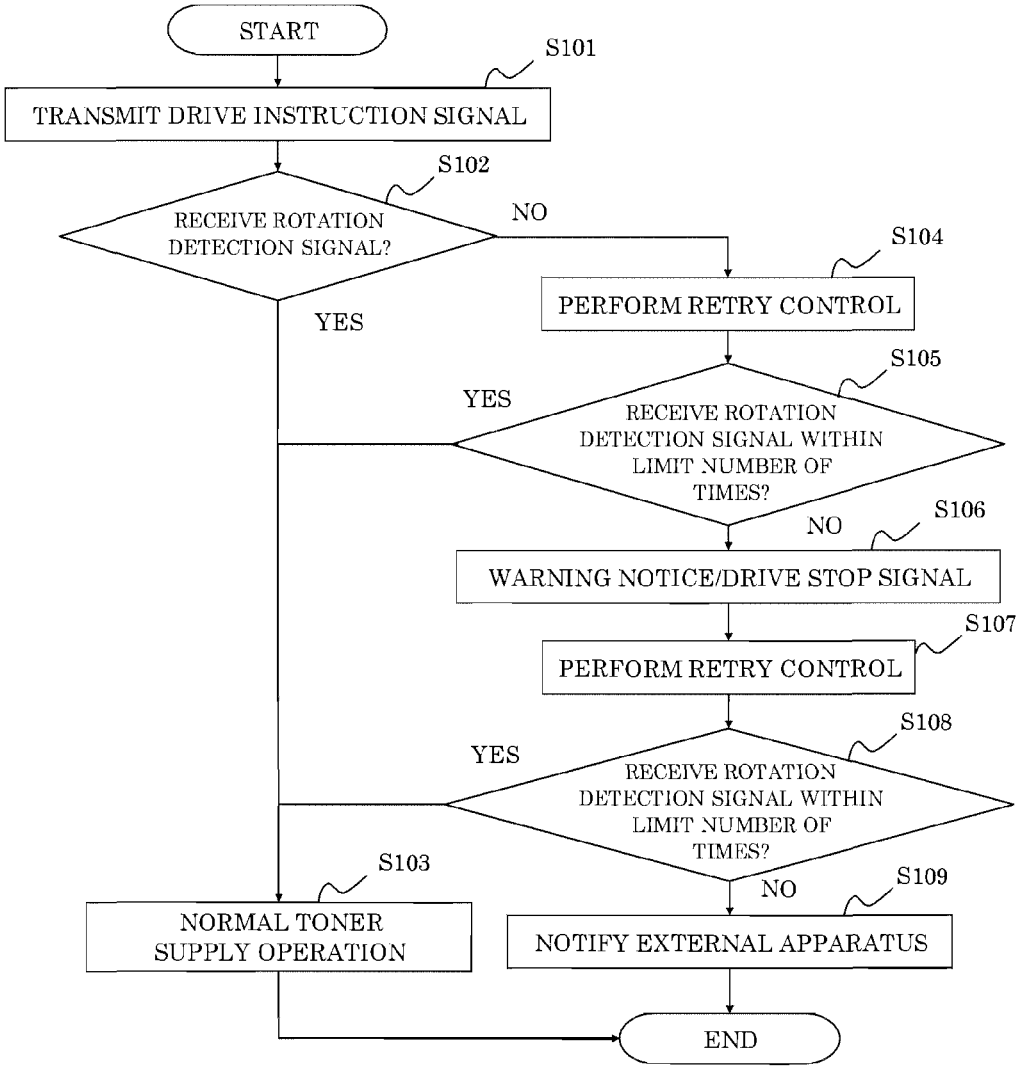
FIG. 10 is a flowchart illustrating a control process in the color printer according to an embodiment of the present disclosure.

Next, how the CPU 79 performs the retry control when an overload state of the toner container 25 occurs immediately after replacement of the toner container 25 or when an image forming operation has not been performed for a long time will be described. FIG. 10 is a flowchart illustrating the control process in the color printer 1 according to an embodiment of the present disclosure.

The CPU 79 initially transmits a drive instruction signal (forward rotation direction) to the motor drive unit 82 (S101). Upon receiving the drive instruction signal (forward rotation direction) from the CPU 79, the motor drive unit 82 causes the current to flow in the drive motor 55. When the toner container 25 is not in the overload state, the motor shaft 65 of the drive motor 55 rotates due to the current, thereby rotating the output shaft 56 and the pulse plate 73. As the pulse plate 73 rotates, a detection light path from the light emitter 77 to the light receiver 78 is formed and interrupted by the slits 76 and the light shielding portion 75. When the sensor 74 of the rotation detection unit 57 detects the formation and interruption of the detection light path, the rotation detection unit 57 transmits the rotation detection signal to the CPU 79. When the CPU 79 receives the rotation detection signal within a specified time (for example, 200 ms) after the CPU 79 transmitted the drive instruction signal (forward rotation direction) to the motor drive unit 82 (S102), the CPU 79 determines that the toner container 25 is not in an overload state and transmits the drive instruction signal (forward rotation direction) to the motor drive unit 82 to perform a normal toner supply operation (S103).

In contrast, when the toner container 25 is in an overload state, an excessive load torque is applied to the drive motor 55. In this situation, the motor shaft 65 of the drive motor 55 does not rotate even when the current flows from the motor drive unit 82 to the drive motor 55. Accordingly, the rotation detection unit 57 does not transmit the rotation detection signal to the CPU 79, and the CPU 79 does not receive the rotation detection signal of the drive motor 55 within the specified time (S102). In this situation, the CPU 79 determines that the toner container 25 is in the overload state and performs the retry control as follows (S104).

The CPU 79 initially transmits the drive stop signal to the motor drive unit 82 causing the drive motor 55 to stop for a specified time (for example, 500 ms). Next, the CPU 79 transmits the drive instruction signal (backward rotation direction) to the motor drive unit 82 causing the drive motor 55 to rotate in the backward rotation direction for a specified time (for example, 200 ms). After that, the CPU 79 transmits the drive stop signal to the motor drive unit 82 causing the drive motor 55 to stop for the specified time (for example, 500 ms). Then, the CPU 79 transmits the drive instruction signal (forward rotation direction) to the motor drive unit 82 causing the drive motor 55 to rotate in the forward rotation direction for the specified time (for example, 200 ms). After that, the CPU 79 transmits the drive stop signal to the motor drive unit 82 causing the drive motor 55 to stop for the specified time (for example, 500 ms).

As described above, the CPU 79 repeats the following cycle: transmission of the drive stop signal, transmission of the drive instruction signal (backward rotation direction), transmission of the drive stop signal, transmission of the drive instruction signal (forward rotation direction), transmission of the drive stop signal, and transmission of the drive instruction signal (backward rotation direction) in this order. Accordingly, the agitating paddles 38 and 40 connected to the drive motor 55 also repeat the following cycle: stop, backward rotation, stop, forward rotation, stop, and backward rotation in this order. With this operation, toner clumped in the toner container 25 is gradually broken up. The above-described retry operation of the agitating paddles 38 and 40 is performed within a specified upper limit number of times (for example, 20 times in each of the forward and backward rotation directions). The upper limit number of times is determined for each type of the toner container 25 in accordance with, for example, the capacity of the toner container 25. The upper limit number of times is stored in the storage unit 80, the memory of the IC tag 53, or other storage unit.

The CPU 79 monitors whether or not the rotation detection signal is received from the rotation detection unit 57 within the specified time (for example, 200 ms) every time the CPU 79 transmits the drive instruction signal (forward rotation direction) while causing the agitating paddles 38 and 40 to perform the retry operation. When the CPU 79 receives the rotation detection signal within the specified time from transmission of the drive instruction signal within the above-described upper limit number of times (S105), the CPU 79 determines that the overload state of the toner container 25 has been cleared and ends the retry control. The CPU 79 transmits the drive instruction signal (forward rotation direction) to the motor drive unit 82 and performs the normal toner supply operation (S103).

In contrast, when the CPU 79 does not receive the rotation detection signal within the specified time from transmission of the drive instruction signal within the above-described upper limit number of times (S105), the CPU 79 determines that the toner container 25 is still in an overload state. In this situation, the CPU 79 outputs the determination result to the operation display unit 81 causing the operation display unit 81 to display a warning notice such as a notice that prompts the user to remove the toner container, shake the toner container well, and remount the toner container. At the same time, the CPU 79 transmits the drive stop signal to the motor drive unit 82 to cause the drive motor 55 to stop (S106).

When a container cover (not shown) provided in the printer main body 2 is opened and closed or the toner container 25 is replaced as a result of the above-described warning notice, the warning notice of the operation display unit 81 is reset and the retry control is again performed (S107). At this time, the retry operation of the agitating paddles 38 and 40 is performed within a specified upper limit number of times (for example, 15 times in each of the forward and backward rotation directions).

When the CPU 79 receives the rotation detection signal within the specified time from transmission of the drive instruction signal within the above-described upper limit number of times (S108), the CPU 79 determines that the overload state of the toner container 25 has been cleared and ends the retry control. The CPU 79 transmits the drive instruction signal (forward rotation direction) to the motor drive unit 82 and performs the normal toner supply operation (S103).

In contrast, when the CPU 79 does not receive the rotation detection signal within the specified time from transmission of the drive instruction signal within the above-described upper limit number of times (S108), the CPU 79 determines that the toner container 25 is still in an overload state. In this case, the CPU 79 transmits a signal to the external apparatus 84 via the PHS communication or the like to notify the external apparatus 84 of the overload state of the toner container 25 (S109).

In an embodiment, as described above, when the CPU 79 determines that the toner container 25 is in the overload state, the retry control is performed so as to break up the clumped toner in the toner container 25, thereby allowing the overload state of the toner container 25 to be cleared. In addition, by performing such an operation to clear an overload state of the toner container 25 initially on the apparatus side, work to be performed by the user can be decreased and convenience to the user can be improved.

In an embodiment, rotation of the drive motor 55 is detected by the rotation detection unit 57. Thus, compared to the situation in which only the current flowing in the drive motor 55 is detected, whether or not the drive motor 55 is rotating can be more reliably detected.

In an embodiment, the rotational phases of the agitating paddles 38 and 40 are adjusted such that the agitating film 49 of each of the agitating paddles 38 and 40 contacts the inner wall surface of the main body 27 at the start of use of the toner container 25 and when the agitating paddles 38 and 40 are stopped. Accordingly, when an overload state of the toner container 25 occurs, the above-described retry control can be performed while causing the agitating films 49 to slidingly contact the inner wall surface of the main body 27. Thus, vibrations occurring due to forward and backward rotation of the agitating paddles 38 and 40 can be transmitted through the agitating films 49 to the inner wall surface of the main body 27, thereby facilitating breaking up the toner adhering to the inner wall surface of the main body 27.

In an embodiment, the agitating members 42*b* are located on one side and the other side of each supporting frame 41 in the axial direction of the supporting frame 41. Each agitating member 42*b* has reverse-taper shapes so that, on a central side of the agitating member 42*b* in the axial direction of the supporting frame 41, a dimension of the agitating member 42*b* in the axial direction of the supporting frame 41 increases toward each of the securing plates 39. Accordingly, as the agitating paddles 38 and 40 rotate in the forward and backward rotation directions in the retry control, forces are generated in directions in which the toner is collected from either side to the central portion in the axial direction of the supporting frame 41. With this structure, circulation of the toner is improved, thereby facilitating breaking up clumped toner in the toner container 25.

Figure 11:
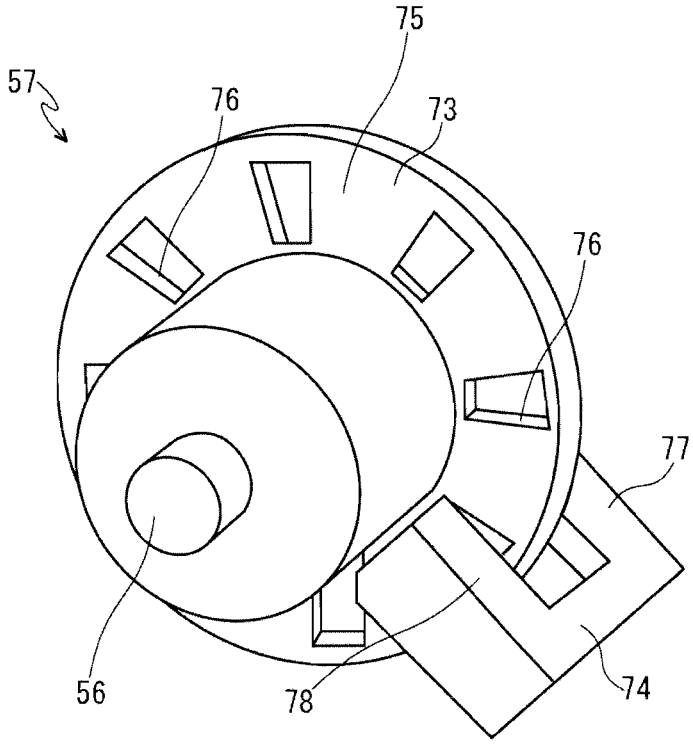
FIG. 11 is a perspective view of a rotation detection unit according to another embodiment.

In an embodiment, the rotation detection unit 57 has the following structure. The light shielding portion 75 having a flange-like shape is provided in the outer periphery of the pulse plate 73, and the light emitter 77 and the light receiver 78 of the sensor 74 are positioned inside and outside the light shielding portion 75 in the radial direction of the pulse plate 73. In another embodiment, as illustrated in FIG. 11, an outer diameter area of the pulse plate 73 may serve as the light shielding portion 75, and the light emitter 77 and the light receiver 78 of the sensor 74 may be positioned on one side and the other side of the pulse plate 73 in the width direction of the pulse plate 73. As described above, the shape of the pulse plate 73 and arrangement of the sensor 74 may be modified where appropriate in accordance with the layout of a product and the like.

In an embodiment, the pulse plate 73 has 12 slits 76. In yet another embodiment, as illustrated in FIG. 11, eight slits 76 may be formed in the pulse plate 73. As described above, the number of slits 76 may be changed where appropriate in accordance with the speed reduction ratio of gears that connect the transportation screw 32 to the pulse plate 73, required detection accuracy, or the like.

In an embodiment, the pulse plate 73 is coaxial with the output shaft 56. In yet another embodiment, the pulse plate 73 may be coaxial with the transportation screw 32 or a different shaft. That is, the pulse plate 73 may be located at any position in a rotation transmission mechanism from the drive motor 55 to the transportation screw 32. In an embodiment, the rotation detection unit 57 including the pulse plate 73 and the sensor 74 is used. In yet another embodiment, the rotation detection unit 57 may include the rotation detection unit 57 having another structure such as a magnetic rotary encoder, a mechanical rotary encoder, or the like.

Figure 12:
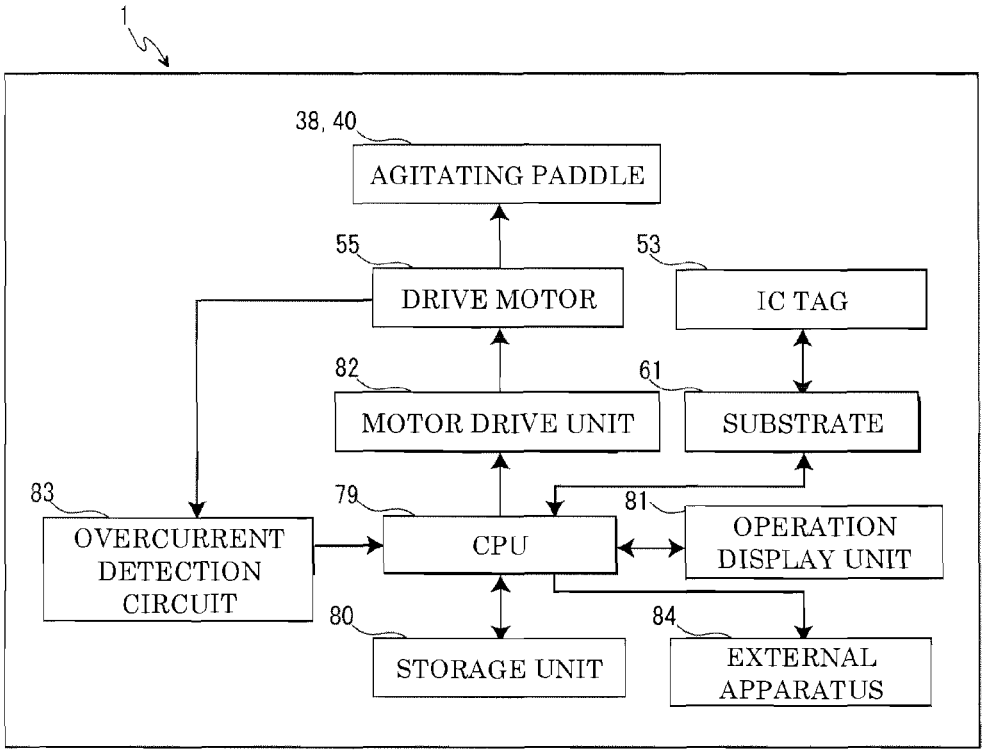
FIG. 12 is a block diagram illustrating the configuration of the color printer according to another embodiment of the present disclosure.

Next, another embodiment of the present disclosure will be described below with reference to FIG. 12. FIG. 12 is a block diagram illustrating the configuration of the color printer according to another embodiment of the present disclosure.

In the previous described embodiment, the rotation detection unit 57 including the pulse plate 73 and the sensor 74 serves as the detection unit. In this embodiment, as illustrated in FIG. 12, an overcurrent detection circuit 83 serves as the detection unit. The overcurrent detection circuit 83 is connected to the drive motor 55 and the CPU 79. The overcurrent detection circuit 83 transmits an overcurrent detection signal to the CPU 79 when the current flowing in the drive motor 55 (referred to as a "drive current" hereafter) exceeds (or is equal to) a threshold value (for example, 0.3 A or 0.9 A). The overcurrent detection circuit 83 may be an existing known circuit that includes, for example, a resistor used to detect the drive current and a comparator that compares the current detected by the resistor to the threshold value. The above-described threshold value of the drive current is determined in accordance with the capacity of the toner container 25 or the like and stored in the storage unit 80, the memory of the IC tag 53, or other storage unit.

Figure 13:
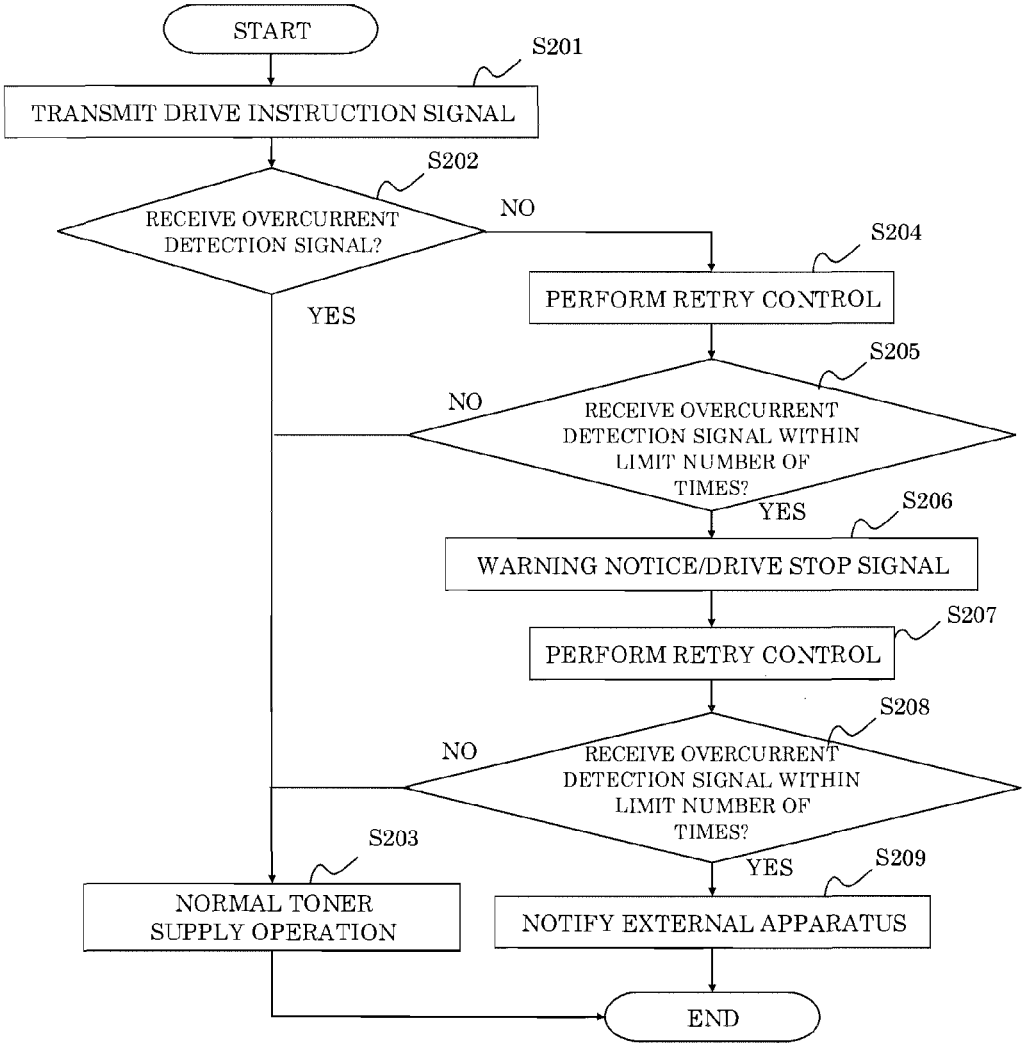
FIG. 13 is a flowchart illustrating a control process in the color printer according to another embodiment of the present disclosure.

How the CPU 79 performs the retry control when the overcurrent detection circuit 83 is used as the detection member as described above will be described below with reference to FIG. 13. FIG. 13 is a flowchart illustrating a control process in the color printer 1 according to an embodiment of the present disclosure.

The CPU 79 initially transmits a drive instruction signal (forward rotation direction) to the motor drive unit 82 (S201). Upon receiving the drive instruction signal (forward rotation direction) from the CPU 79, the motor drive unit 82 causes the current to flow in the drive motor 55. When the toner container 25 is not in an overload state, the motor shaft 65 of the drive motor 55 normally rotates and the drive current maintains a normal value. Accordingly, the overcurrent detection circuit 83 does not transmit the overcurrent detection signal to the CPU 79. Thus, the CPU 79 does not receive the overcurrent detection signal (S202). The CPU 79 determines that the drive motor 55 is not in an overload state and transmits the drive instruction signal (forward rotation direction) to the motor drive unit 82 and performs the normal toner supply operation (S203).

In contrast, when the toner container 25 is in an overload state, an excessive load torque is applied to the drive motor 55. In this case, the motor shaft 65 of the drive motor 55 does not rotate even when the current flows from the motor drive unit 82 to the drive motor 55. Accordingly, the drive current is equal to or greater than the threshold value flows in the drive motor 55, and the overcurrent detection circuit 83 transmits the overcurrent detection signal to the CPU 79. As a result, the CPU 79 receives the overcurrent detection signal (S202), determines that the toner container 25 is in an overload state, and performs the retry control similar to that performed in the above-described an embodiment (S204). That is, the CPU 79 repeats the following cycle: transmission of the drive stop signal, transmission of the drive instruction signal (backward rotation direction), transmission of the drive stop signal, transmission of the drive instruction signal (forward rotation direction), transmission of the drive stop signal, and transmission of the drive instruction signal (backward rotation direction) in this order. Accordingly, the agitating paddles 38 and 40 connected to the drive motor 55 also repeats the following cycle: stop, backward rotation, stop, forward rotation, stop, and backward rotation in this order. With this operation, the clumped toner in the toner container 25 is gradually broken up.

The CPU 79 monitors whether or not the overcurrent detection signal is transmitted from the overcurrent detection circuit 83 every time the CPU 79 transmits the drive instruction signal (forward rotation direction) while causing the agitating paddles 38 and 40 to perform the retry operation. When the CPU 79 does not receive the overcurrent detection signal from the overcurrent detection circuit 83 within the upper limit number of times the retry control is performed (for example, 20 times in each of the forward and backward rotation direction) (S205), the CPU 79 determines that the overload state of the toner container 25 has been cleared and ends the retry control. The CPU 79 transmits the drive instruction signal (forward rotation direction) to the motor drive unit 82 and performs the normal toner supply operation (S203).

In contrast, when the CPU 79 receives the overcurrent detection signal within the above-described upper limit number of times (S205), the CPU 79 determines that the toner container 25 is still in an overload state. In this situation, the CPU 79 outputs the determination result to the operation display unit 81 to cause the operation display unit 81 to display a warning notice such as a notice that prompts the user to remove the toner container, shake the toner container well, and remount the toner container. At the same time, the CPU 79 transmits the drive stop signal to the motor drive unit 82 to cause the drive motor 55 to stop (S206).

As a result of the above-described warning notice, if a container cover (not shown) provided in the printer main body 2 is opened and closed, or the toner container 25 is replaced, the warning notice of the operation display unit 81 is reset and the retry control is again performed (S207). At this time, the retry operation of the agitating paddles 38 and 40 is performed within a specified upper limit number of times (for example, 15 times in each of the forward and backward rotation directions).

When the CPU 79 does not receive the overcurrent detection signal from the overcurrent detection circuit 83 within the above-described upper limit number of times (S208), the CPU 79 determines that the overload state of the toner container 25 has been cleared and ends the retry control. The CPU 79 transmits the drive instruction signal (forward rotation direction) to the motor drive unit 82 and performs the normal toner supply operation (S203).

In contrast, when the CPU 79 receives the overcurrent detection signal within the above-described upper limit number of times (S208), the CPU 79 determines that the toner container 25 is still in the overload state. In this situation, the CPU 79 transmits a signal to the external apparatus 84 to notify the external apparatus 84 of the overload state of the toner container 25 (S209).

In an embodiment, as described above, the current flowing in the drive motor 55 is detected. According to this structure, whether or not the drive motor 55 is rotating can be detected without use of components such as the pulse plate 73 and the sensor 74. Thus, the structure of the device can be simplified.

In an embodiment, the overcurrent flowing in the drive motor 55 is detected by the overcurrent detection circuit 83. In another embodiment, the overcurrent flowing in the output stage of the motor drive circuit as the motor drive unit 82 may be detected by the overcurrent detection circuit 83. In an embodiment, the overcurrent detection circuit 83 compares the value of the drive current flowing in the drive motor 55 to the threshold value. In yet another embodiment, the CPU 79 may compare the value of the drive current flowing in the drive motor 55 to the threshold value.

In both embodiments, when the overload state of the toner container 25 is cleared, the retry control is ended regardless of whether or not the retry control has been performed the specified upper limit number of times, and the normal toner supply operation is performed. In this situation, an advantage of decreasing the standby time for the user can be obtained. In contrast, in yet another embodiment, the retry control may be performed until the specified upper limit number of times is reached. In this situation, the advantage is that the overload state of the toner container 25 can be more reliably cleared.

In an embodiment, the transportation unit is structured by the transportation screw 32. In yet another embodiment, the transportation unit may be structured by a roller-shaped member. Or the shutter that opens and closes the discharge port 30 may be positioned with the transportation unit. In this situation, the shutter is connected to the drive motor 55. In an embodiment, the agitating units are structured by the agitating paddles 38 and 40. The agitating unit may be structured by a screw-shaped member in yet another embodiment.

In an embodiment, the toner container 25 is connected to the developing unit 11 through the toner pipe 31. In yet another embodiment, the toner container 25 may be connected to the developing unit 11 through an intermediate hopper, or the toner container 25 may be directly removably attached to the developing unit 11.

In an embodiment, the present disclosure is used with a tandem color printer 1. In other embodiments, the present disclosure may be used with rotary color printers, monochrome printers, copying machines, digital multi-function peripherals, facsimile machines, and other image forming apparatuses.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. An image forming apparatus comprising:

a toner case that includes a main body that contains toner, and an agitating unit rotatably provided in the main body that agitates the toner;

a drive section that includes a driving unit that drives the agitating unit, and a detection unit that detects a driving state of the driving unit; and a control unit that is able to transmit a drive instruction signal to the driving unit and is able to receive a detection signal regarding the driving state of the driving unit from the detection unit, wherein the control unit determines whether or not the toner case is in an overload state in accordance with a reception state of the detection signal from the detection unit, and performs a retry control when the control unit determines that the toner case is in the overload state, the retry control causing the driving unit to repeatedly rotate the agitating unit forward and backward, the agitating unit is rotatably supported by the main body and includes an agitating film provided in an axial direction of the agitating unit, the agitating film is brought into contact with and moved away from an inner wall surface of the main body as the agitating unit rotates, and a rotational phase of the agitating unit is adjusted such that, at the start of use of the toner containing case, the agitating film contacts the inner wall surface of the main body.

2. The image forming apparatus according to claim 1, further comprising:

an operation display unit connected to the control unit, and the control unit causes the operation display unit to display a warning notice when the control unit determines that the toner case is in the overload state.

3. The image forming apparatus according to claim 2, wherein the operation display unit displays the warning notice when the overload state continues for a time that is equal to or longer than a specified time.

4. The image forming apparatus according to claim 1, wherein the driving state of the driving unit detected by the detection unit is rotation of the driving unit, and when the control unit does not receive a rotation detection signal from the detection unit within a specified time after the control unit transmitted the drive instruction signal to the driving unit, the control unit determines that the toner case is in the overload state.

5. The image forming apparatus according to claim 1, wherein the driving state of the driving unit detected by the detection unit is a current flowing in the driving unit, and when the current flowing in the driving unit detected by the detection unit is equal to or greater than a specified threshold value, the control unit determines that the toner case is in the overload state.

6. An image forming apparatus comprising:

a toner case that includes a main body that contains toner, and an agitating unit rotatably provided in the main body that agitates the toner;

a drive section that includes a driving unit that drives the agitating unit, and a detection unit that detects a driving state of the driving unit; and a control unit that is able to transmit a drive instruction signal to the driving unit and is able to receive a detection signal regarding the driving state of the driving unit from the detection unit, wherein the control unit determines whether or not the toner case is in an overload state in accordance with a reception state of the detection signal from the detection unit, and performs a retry control when the control unit determines that the toner case is in the overload state, the retry control causing the driving unit to repeatedly rotate the agitating unit forward and backward, the agitating unit is rotatably supported by the main body and includes an agitating film provided in an axial direction of the agitating unit, the agitating film is brought into contact with and moved away from an inner wall surface of the main body as the agitating unit rotates, and a rotational phase of the agitating unit is adjusted such that, when the agitating unit is stopped, the agitating film contacts the inner wall surface of the main body.

7. An image forming apparatus comprising:

a toner case that includes a main body that contains toner, and an agitating unit rotatably provided in the main body that agitates the toner;

a drive section that includes a driving unit that drives the agitating unit, and a detection unit that detects a driving state of the driving unit; and a control unit that is able to transmit a drive instruction signal to the driving unit and is able to receive a detection signal regarding the driving state of the driving unit from the detection unit, wherein the control unit determines whether or not the toner case is in an overload state in accordance with a reception state of the detection signal from the detection unit, and performs a retry control when the control unit determines that the toner case is in the overload state, the retry control causing the driving unit to repeatedly rotate the agitating unit forward and backward, and the agitating unit includes a supporting frame rotatably supported by the main body and provided with a pair of securing members arranged in an axial direction of the supporting frame, the pair of securing members opposing each other, a plurality of agitating members spaced apart from each other by a specified distance in the axial direction of the supporting frame, each end of each agitating member being secured to a corresponding one of the pair of securing members, and wherein each of the agitating members provided on one side and the other side in the axial direction has a reverse-taper shape so that, on a central side of the agitating member in the axial direction, a dimension of the agitating member in the axial direction increases toward each of the securing members.

* * * * *